US008790072B2

(12) United States Patent
Boldt

(10) Patent No.: US 8,790,072 B2
(45) Date of Patent: Jul. 29, 2014

(54) BEARING ASSEMBLY FOR A VERTICAL TURBINE PUMP

(75) Inventor: Daniel E. Boldt, Fresno, CA (US)

(73) Assignee: Weir Floway, Inc., Fresno, CA (US)

( * ) Notice: Subject to any disclaimer, the term of this patent is extended or adjusted under 35 U.S.C. 154(b) by 0 days.

(21) Appl. No.: 13/587,178

(22) Filed: Aug. 16, 2012

(65) Prior Publication Data

US 2013/0045078 A1 Feb. 21, 2013

Related U.S. Application Data

(60) Provisional application No. 61/523,949, filed on Aug. 16, 2011.

(51) Int. Cl.
*F01D 25/16* (2006.01)

(52) U.S. Cl.
USPC ..... 415/112; 416/174; 384/91

(58) Field of Classification Search
USPC ..... 415/110, 111, 112, 229; 416/174; 384/91, 92, 114, 479, 130
See application file for complete search history.

(56) References Cited

U.S. PATENT DOCUMENTS 3,288,075 A * 11/1966 Lung ..... 415/112
3,955,859 A 5/1976 Stella et al.
4,279,452 A * 7/1981 Naffziger ..... 384/131
4,743,034 A 5/1988 Kakabaker et al.
5,147,179 A 9/1992 Bransch
5,413,459 A 5/1995 Woodall et al.
6,318,896 B1 * 11/2001 Meng et al. ..... 384/114
6,416,225 B1 * 7/2002 Cioceanu et al. ..... 384/97
6,939,051 B2 9/2005 Elmgren et al.
6,966,746 B2 11/2005 Cardenas et al.
7,153,028 B2 * 12/2006 Oelsch ..... 384/100
7,665,975 B2 2/2010 Parmeter et al.

FOREIGN PATENT DOCUMENTS

EP 318638 A2 * 6/1989
JP 55054766 A 4/1980
JP 6081788 A 3/1994
JP 9303281 A 11/1997
JP 2008202585 A 9/2008
JP 2008202586 A 9/2008
WO 2004104434 A1 12/2004
WO 2008124950 A1 10/2008

* cited by examiner

*Primary Examiner* — Ned Landrum
*Assistant Examiner* — Ryan Ellis
(74) *Attorney, Agent, or Firm* — Morriss O'Bryant Compagni

(57) ABSTRACT

A bearing assembly for supporting a drive shaft of a pump is structured with a cylindrical body having an internal cavity filled with a lubricant, a sealing element arrangement positioned at one or both ends of the cylindrical body and a pressure equalization element that functions to equalize the pressure differential that exists between an area within the cylindrical body and outside of the cylindrical body to improve the operating life of the sealing arrangement and the bearing assembly.

23 Claims, 12 Drawing Sheets

BEARING ASSEMBLY FOR A VERTICAL TURBINE PUMP

CROSS REFERENCE TO RELATED APPLICATIONS

This application is a non-provisional application claiming priority to U.S. provisional application Ser. No. 61/523,949, filed Aug. 16, 2011, the contents of which are incorporated herein in their entirety.

TECHNICAL FIELD

This disclosure relates to vertical turbine pumps of the type used in the pumping of water or other fluids from wells and sumps, and through pipelines, and specifically relates to a bearing assembly for supporting a drive shaft that drives one or more impellers of the pump.

BACKGROUND OF THE DISCLOSURE

Vertical turbine pumps are commonly used in a variety of industries to pump water or other fluids from a source below ground level, such as a well or sump. Another common application of vertical turbine pumps is in a pressure boosting configuration in a pipeline. Typical industries in which vertical turbine pumps are used include agriculture, water/wastewater, industrial, oil & gas and mining.

Vertical turbine pumps may be structured and configured in a number of ways. In general, however, vertical turbine pumps comprise a drive shaft which, in operation of the pump, is oriented in a vertical direction to operatively rotate at least one impeller. A drive motor is typically located at the upper end of the vertically-oriented drive shaft, and the impeller or impellers are positioned at the opposing end of the vertical drive shaft. An impeller of the pump may typically be housed in a structure known in the industry as a bowl, and a vertical turbine pump having a number of impellers will be configured with a series of bowls in an assembly, each bowl housing an impeller.

In operation, the vertical turbine pump is vertically oriented with the bowl assembly positioned in a sump, well or barrel and the motor or drive means is located above ground. The rotation of the impeller or impellers moves fluid upwardly through vertically-oriented piping to an outlet or discharge that it positioned either above ground or below ground, depending on the application requirements. In certain applications, the vertical turbine pump may be oriented at an angle from the vertical direction.

Vertical turbine pumps further include bearings which surround and support the drive shaft in its rotation. Bearings are located in variable positions along the drive shaft of vertical turbine pumps, including between the drive shaft and the bowl or pump casing, at the suction bell, at column lineshafts and at seal housings near the drive motor. The bearings must be lubricated to maintain optimal operation of the bearing as the drive shaft rotates within the bearing. One common means of lubricating the bearings in a vertical turbine pump is to employ as the lubricant the fluid being pumped, thereby avoiding the use of oil or grease as the lubricating agent. This is accomplished by directing the high pressure pumping fluid into the bearings by venting means. An example of such means is described in U.S. Pat. No. 5,147,179, which discloses a cascaded venting system for providing pumping fluid as the lubricant to a series of pumping section bearings in a multistage pump.

While lubrication systems of the type described in the prior art are satisfactory for use in pumping applications where the fluid being pumped is clear liquid or liquid with very low solids content, these systems are problematic in applications where the fluid being pumped contains solids or particulate matter. The solids in the pumping fluid are abrasive and cause a wearing of the adjacent surfaces of and between the rotating drive shaft and the bearing. The degradation of the bearings results in reduced pumping efficiency and excessive vibration, and the pump must eventually be taken out of service for significant repair.

In other known pump systems, a clean fluid flushing system is used to flush the bearings to eliminate solids at the bearing surfaces. However, such clean fluid flushing systems are not always available given certain factors like pumping location. Furthermore, the use of clean flushing fluid can add significant operational costs. Enclosed lineshaft bearings comprising an enclosed tube are also used to isolate lineshaft bearings, and a clean fluid flushing system is used to lubricate the bearing. However, such enclosed lineshaft bearing systems, while useful for the lineshaft, cannot be used for bowl or pump casing bearings.

Thus, new means for providing extended bearing life in vertical turbine pumps, particularly when used in the processing of slurries or under other abrasive conditions, is needed.

SUMMARY OF THE DISCLOSURE

In a first aspect, embodiments are disclosed of a bearing assembly for supporting a drive shaft within a vertical turbine pump, the bearing assembly comprising:

a cylindrical body having a continuous wall defining a passageway for receiving a drive shaft therethrough, and having an outer surface, an inner surface, a first end and a second end;

an internal cavity formed along said inner surface of said cylindrical body;

an annular shoulder extending inwardly from at least one of said first end and said second end, said annular shoulder being structured to receive and retain at least one sealing element; and a pressure equalization element formed in said cylindrical body.

The bearing assembly of this aspect provides equalization of pressure between the internal cavity and an area of pressure outside of the cylindrical body which effectively reduces conventional wear in the sealing elements associated with the bearing, thereby increasing the service life of the sealing elements and the bearing assembly.

In certain embodiments, the bearing assembly further comprises an annular shoulder formed at each of said first end and said second end of said cylindrical body.

In certain embodiments the bearing assembly further comprises an opening formed through said continuous wall and positioned to provide fluid communication between said internal cavity and said pressure equalization element.

In certain embodiments, said pressure equalization element may be a labyrinthine channel formed along said outer surface of said cylindrical body and extending from said opening to one of said first end or said second end of said cylindrical body.

In certain embodiments, said pressure equalization element can be a spiral channel formed along said outer surface of said cylindrical body to encircle said cylindrical body, and formed to extend from said opening to one of said first end or said second end of said cylindrical body.

In certain embodiments, the at least one sealing element comprises a series of lip seals.

In certain embodiments, said internal cavity of the bearing assembly can be filled with a lubricant.

In a second aspect, embodiments are disclosed of a vertical turbine pump, comprising:

a drive shaft being operatively connected to a drive means for rotating said drive shaft;

a casing element surrounding said drive shaft and providing a support structure;

a bearing positioned between said casing element and said drive shaft, said bearing comprising, a cylindrical body having a continuous wall defining a passageway for receiving the drive shaft therethrough, and having an outer surface, an inner surface, a first end and a second end;

an internal cavity formed along said inner surface of said cylindrical body;

an annular shoulder extending inwardly from at least one of said first end and said second end, said annular shoulder being structured to receive and retain at least one sealing element therein; and a pressure equalization element located between said casing element and said bearing and being in fluid communication with said internal cavity of said cylindrical body, the pressure equalization element containing, at least in part, a quantum of lubricant; and at least one impeller operatively connected to said drive shaft for rotation thereby.

The vertical pump of this aspect, by virtue of the pressure equalization element, is able to provide equalization of pressure between the internal cavity of the bearing and an area of pressure outside of the bearing which effectively reduces conventional wear in the sealing elements associated with the bearing, thereby increasing the service life of the sealing elements and the bearing assembly.

In certain embodiments of the vertical turbine pump, the pressure equalization element comprises a labyrinthine channel.

In certain embodiments, the labyrinthine channel is formed in the outer surface of said cylindrical body.

In other embodiments, the labyrinthine channel is formed in the casing element.

In other embodiments of the vertical turbine pump, the pressure equalization element comprises a spiral channel.

In certain embodiments, the spiral channel is formed in the outer surface of the cylindrical body.

In other embodiments, the spiral channel is formed in the casing element.

In a third aspect, embodiments are disclosed of a pressure equalization element for a bearing assembly of a pump, the element comprising:

a bearing positioned in use between a rotational drive shaft and a stationary pump casing portion, said bearing having an internal cavity for retaining a lubricant therein, and having an opening extending from said internal cavity to a point exterior to said bearing;

a channel element extending from said opening of said bearing to a position exterior to said bearing, wherein the pressure equalization element contains at least in part a quantum of lubricant.

The pressure equalization element of this aspect provides equalization of pressure between the internal cavity of the bearing and an area of pressure outside of the bearing which effectively reduces conventional wear in sealing elements associated with the bearing, thereby increasing the service life of the sealing elements and the bearing assembly.

In certain embodiments of the pressure equalization element, the channel element is formed in an outer surface of said bearing.

In an alternative embodiment of the pressure equalization element, the channel element is formed in said stationary pump casing portion.

In a fourth aspect of the present disclosure, methods are disclosed for supporting a rotational drive shaft in a pump, comprising:

providing a drive shaft having an outer surface and a rotational axis;

providing a bearing comprising a cylindrical body having an internal cavity and a passage formed through the cylindrical body for receiving a drive shaft, and having at least one sealing element;

providing a pressure equalization element between the drive shaft and the bearing;

positioning the drive shaft through the passage of the bearing to position the bearing about the drive shaft and to position the pressure equalization element between the drive shaft and the interior cavity of the bearing; and generating a pressure differential across the bearing to act upon the pressure equalization element to preserve the at least one sealing element of the bearing and to provide isolation of the interior cavity from an area of pressure external to the bearing.

The method of this aspect provides means for equalizing pressure between the internal cavity of the bearing and the pressure that exists outside of the bearing to effectively reduce the amount of wear that is conventional exerted on the sealing elements associated with the bearing. Accordingly the service life of the sealing elements and the bearing assembly are increased by this method.

In another aspect of the methods for supporting a rotational drive shaft, the cylindrical body of the bearing includes an internal cavity formed to be oriented toward and positioned adjacent the drive shaft, and wherein the pressure equalization element of the cylindrical body further includes a labyrinthine channel in fluid communication with the internal cavity and extending from the internal cavity to an outer surface of the cylindrical body, the labyrinthine channel containing an amount of lubricant, whereby, in generating the pressure differential, the pressure equalization element operates to equalize pressure between the internal cavity and the outside of the bearing.

In a fifth aspect of the disclosure, methods for assembly of a vertical turbine pump having a pressure equalization element are disclosed, comprising:

providing a drive shaft;

providing a supporting structure in proximity to the drive shaft;

providing a bearing comprising a cylindrical body having a passage for receiving a drive shaft therethrough, and further having a pressure equalization element;

positioning the bearing about the drive shaft and in engagement with the supporting structure; and orienting the pressure equalization element toward an area of formation of increased pressure resulting from rotation of the drive shaft to facilitate equalization of pressure between a point internal to the bearing proximate the drive shaft and the area of formation of increased pressure.

The method of assembly in accordance with this aspect provides a vertical turbine pump that is structured with pressure equalization capabilities that increase the service life of the sealing elements associated with the bearing, thereby providing beneficial operating conditions for the pump.

In certain embodiments of the methods of assembly of a vertical turbine pump, the cylindrical body of the bearing includes an internal cavity formed to be oriented toward and positioned adjacent the drive shaft, and wherein the pressure equalization element of the cylindrical body further includes a channel in fluid communication with the internal cavity, which extends from the internal cavity to an outer surface of the cylindrical body, the channel containing an amount of lubricant, wherein orienting the pressure equalization element toward an area of increased pressure further comprises exposing the lubricant within the channel to the area of increased pressure.

In certain other embodiments, the cylindrical body of the bearing includes at least one sealing element positioned at one end of the cylindrical body, and the method further comprises orienting the cylindrical body of the bearing to dispose the at least one sealing element toward the area of increased pressure.

In yet other certain embodiments, the internal cavity and channel of the pressure equalization element are filled with lubricant after positioning the bearing about the drive shaft. In other embodiments, a lubricant may be positioned in the channel of the pressure equalization element prior to the bearing being fitted about the drive shaft.

In one aspect of the present disclosure, a bearing for use in a vertical turbine pump is structured to provide improved sealing of the bearing from abrasive materials or solids to thereby extend the service life of the bearing and the operation of the vertical turbine pump.

In another aspect of the disclosure, a bearing for use in a vertical turbine pump is structured to provide pressure equalization between an internal portion of the bearing and the environment outside of the bearing to improve the operability of the bearing, especially under high pressure conditions, and to thereby increase the service life of the bearing and the sealing elements.

The bearing of the present disclosure generally comprises a journal bearing which is lubricated by oil or grease that is pre-loaded in the bearing during pump assembly.

In another aspect of the disclosure, the bearing is structured with an isolation system that isolates and protects an interior surface of the bearing from exposure to abrasive fluids. The isolation system may comprise a sealing element that is positioned to isolate the bearing surface from infiltration of abrasive fluids, especially under high pressure conditions. The sealing element may, in some suitable embodiments, be a lip seal assembly and comprise a series of double lip seals that are made of polytetrafluoroethylene (PTFE) to increase the strength of the lip seals. In yet another aspect of the disclosure, each lip seal in the assembly may be structured with at least one annular reinforcing member to improve the comprehensive contact of the lip seal with the shaft surface, especially under high pressure conditions, and to provide improved service life.

In yet another aspect of the disclosure, the bearing is structured with a pressure equalization element which operates to equalize the pressure between an internal portion or cavity of the bearing and the environment outside of the bearing to improve the function of the bearing under high pressure conditions. In one particularly suitable embodiment of the pressure equalization element, the bearing is configured with a channel or groove that extends along a surface of the bearing and extends from an inner portion of the bearing to an outer portion of the bearing. The channel or groove may, in one embodiment, be located on an outer (non-bearing) surface of the bearing. In another embodiment, the channel or groove may be located in the surface of a supporting structure that supports the bearing, such as a pump casing positioned adjacent the outer surface of the bearing.

Lubricant, such as grease, may be pre-packed in the inner portion of the bearing and in the channel or groove of the pressure equalization element. High pressure existing external to the bearing exerts pressure on or through the channel, thereby forcing the lubricant into the internal regions of the bearing to maintain optimal lubrication of the bearing surfaces. Equalization of the pressure between the interior of the bearing and the environment outside of the bearing has the added benefit of improving the life of the sealing assembly or sealing elements and allows the seals to operate in high pressure applications, thus increasing the service life of the bearing.

In another aspect of the disclosure, the pressure equalization element may be associated with the stationary surface that supports the bearing, also referred to as the "bearing surface" or "supporting surface," such as, for example, the pump casing or lineshaft columns. The pressure equalization element may comprise a pathway formed in the bearing surface that extends from a point proximate the interior of the bearing to a point proximate the exterior of the bearing to provide a channel that communicates with the interior of the bearing and the environment exterior to the bearing. Consequently, pressure that exists external to the bearing is applied to the channel formed in the bearing surface which, in turn, exerts pressure on the interior of the bearing to thereby force the lubricant into the internal regions of the bearing to maintain optimal lubrication of the bearing surfaces.

The bearing of the present disclosure presents an improvement over prior art bearing systems in vertical turbine pumps by being structured in a manner that increases the service life of the bearing and by eliminating the need to provide flushing systems that are costly and may clog or become worn, thereby causing reduced pump efficiency or downtime for repair.

Other aspects, features, and advantages will become apparent from the following detailed description when taken in conjunction with the accompanying drawings, which are a part of this disclosure and which illustrate, by way of example, principles of any inventions disclosed.

DESCRIPTION OF THE FIGURES

The accompanying drawings facilitate an understanding of the various embodiments.

DETAILED DESCRIPTION OF EMBODIMENTS

Figure 1:
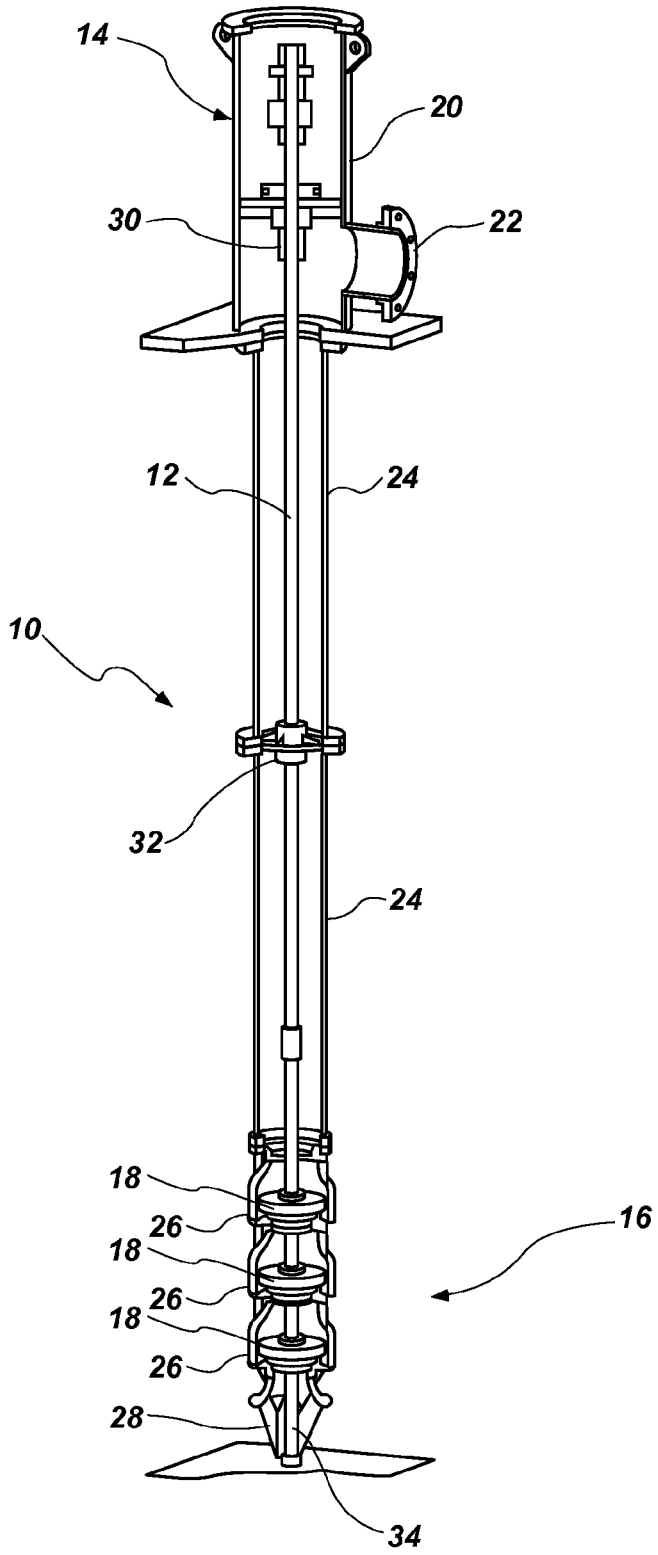
FIG. 1 is a perspective view of a representative vertical turbine pump of the type in which the bearing of the disclosure may be used.

While the bearing assembly disclosed herein may be adaptable for use in any number of varieties of pumps, the bearing assembly is described herein with respect to its placement in a vertical turbine pump, as one example. FIG. 1 depicts the general structure of a multistage vertical turbine pump of the type in which the bearing of the disclosure is suitably used. The vertical turbine pump 10 is generally structured with a drive shaft 12 that extends from a first end 14, comprising a drive end, to a second end 16, comprising a suction end. A drive motor (not shown) is positioned near the first end 14 of the drive shaft 12 to which the drive shaft is operatively coupled to effect rotation of the drive shaft. At the second end 16 of the drive shaft 12 is positioned one or more impellers 18, three such impellers being illustrated in a multistage configuration as depicted in FIG. 1.

The drive shaft 12 extends from a discharge head assembly 20, which includes a discharge outlet 22, through one or more column pipes 24 which are secured together to produce extended lengths of the pump 10. Secured to the end of the lowermost column pipe 24 are one or more bowls 26 that are serially secured together, each bowl being structured to house an impeller 18. In alternative configurations of the pump, the bowls 26 may be secured directly to the discharge head 20. To the end of the lowermost bowl may be connected a suction bell 28 or other adaptive device for drawing fluid into the pump.

The vertical turbine pump 10 may be structured with a number of bearings or bearing assemblies along the length of the drive shaft 12. For example, the drive shaft 12, at the first end 14 or drive end of the pump, extends through a seal bearing assembly 30 which seals the discharge head assembly 20 from the leakage of pumping fluid toward the drive motor. Additionally, lineshaft bearings 32 are provided at coupling points of lengths of the drive shaft 12 and at other locations, as required by the design. Bearings, as described more fully below, are provided in each of the bowls 26 of the pump. Additionally, a suction bell bearing 34 is provided in the suction bell 28 to support the drive shaft 12. The bearings of the disclosure described hereinafter are suitable for use in any of these bearing locations, but is described below with respect to the position of a bearing in a bowl 26 of the pump as one exemplar use.

Figure 2:
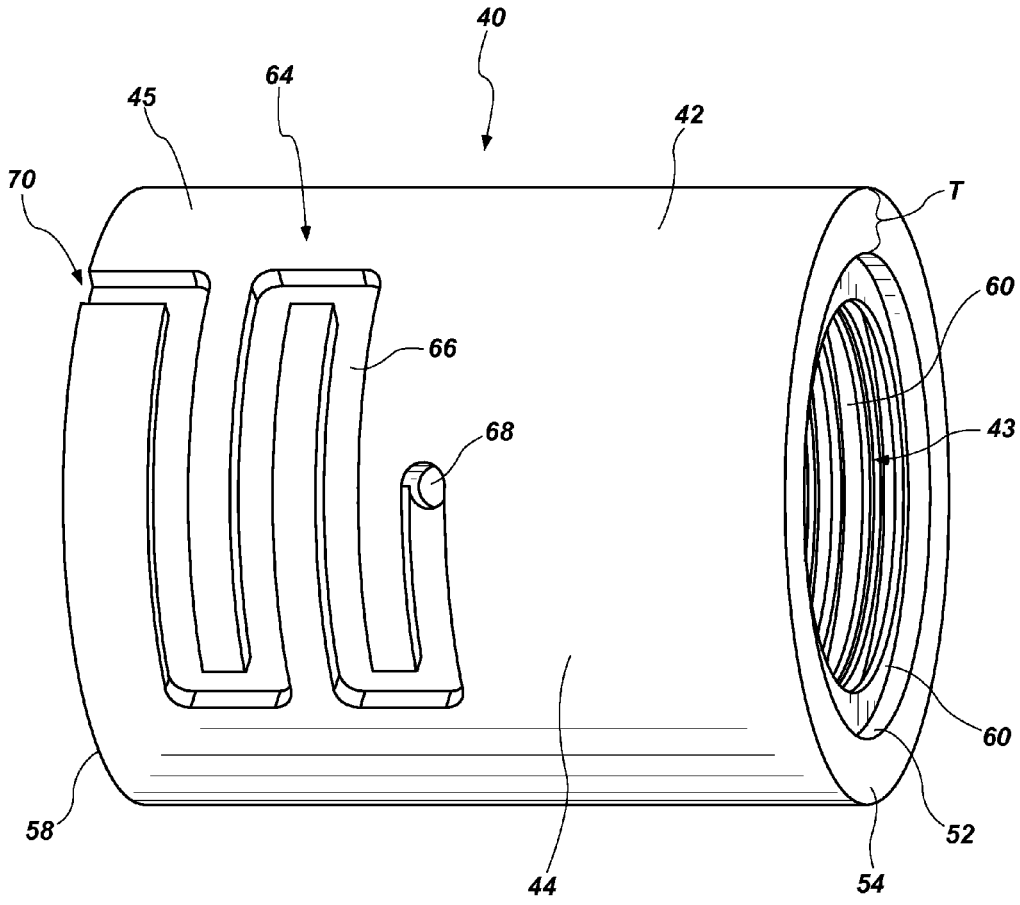
FIG. 2 is a perspective view of bearing in accordance with one aspect of the disclosure.
Figure 3:
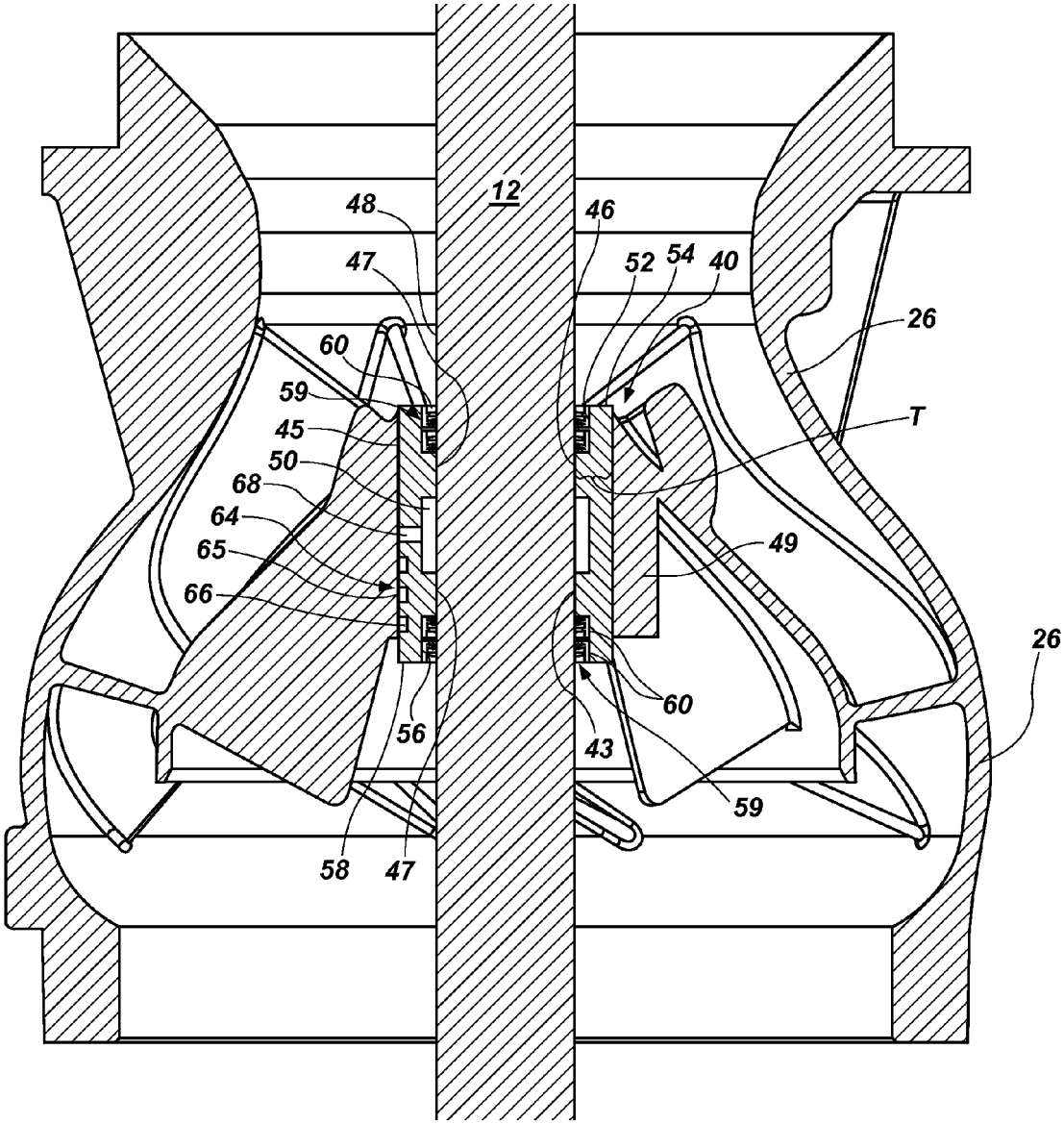
FIG. 3 is a view in cross section of a pump casing depicting the bearing shown in FIG. 2 positioned about the drive shaft of a vertical turbine pump.
Figure 4:
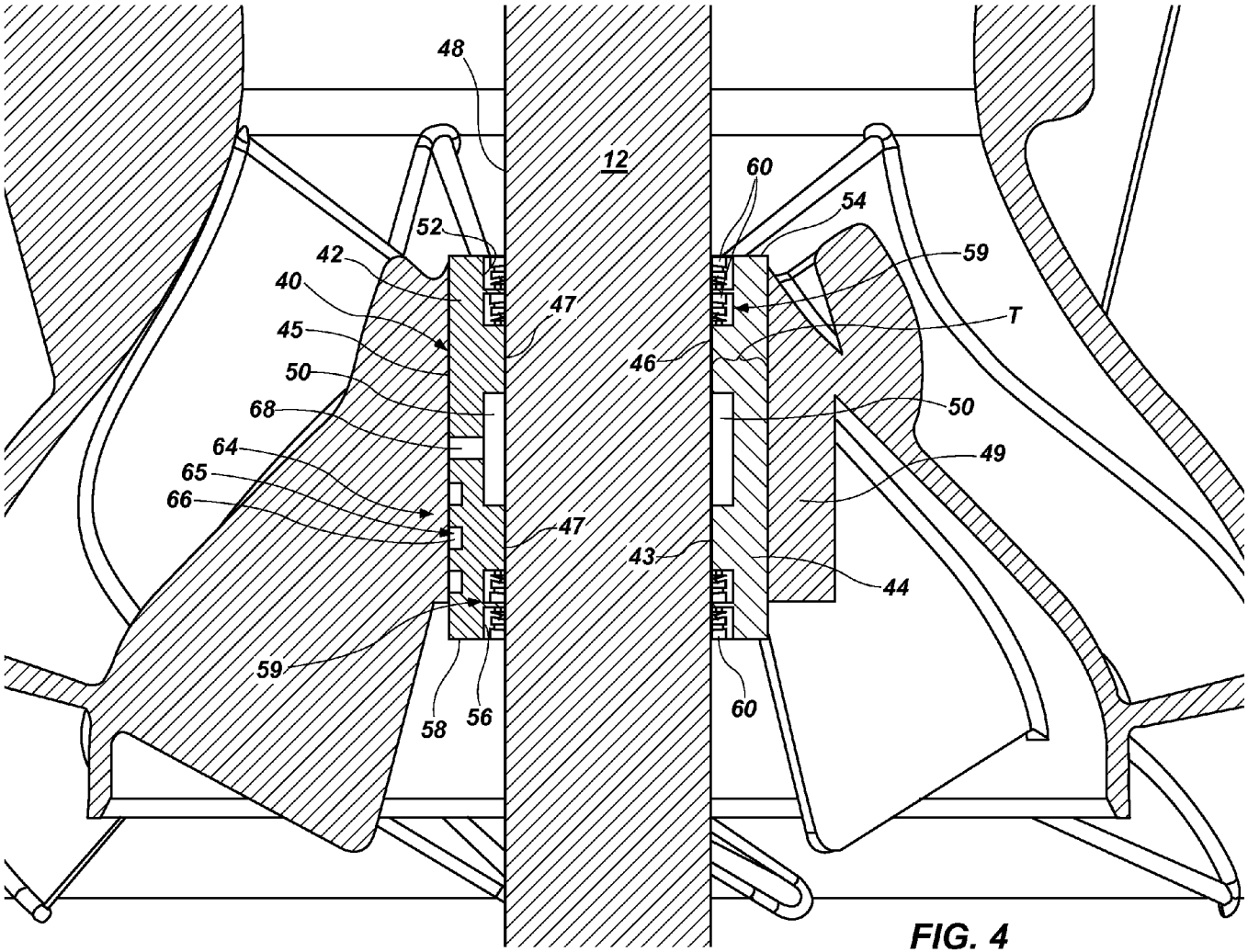
FIG. 4 is an enlarged view of the cross section illustrated in FIG. 3.

FIGS. 2-4 illustrate a first aspect of the bearing 40 of this disclosure. The bearing 40 generally comprises a generally cylindrical body 42 having a continuous wall 44 of defined thickness T. The continuous wall 44 defines a central passageway 43 through the cylindrical body 42 which is sized to receive a drive shaft 12 therethrough. The continuous wall 44 has an outer surface 45 and an inner surface 46, as seen in FIGS. 3 and 4. The inner surface 46 provides an adjacent surface, also referred to as a pad 47, to the outer surface 48 of the rotating drive shaft 12. The outer surface 45 of the bearing 40 is positioned against a supporting structure 49, which is shown in FIG. 3 as the bowl 26. The bearing 40 can be press fit or bolted into the supporting structure 49 by known means. The cylindrical body 42 is depicted in the drawings as being tubular, but the outer wall may be configured in any number of ways to adapt the bearing body to a particular use or position within a pump.

The bearing 40 may be made of any suitable material, including hardened metal material. The adjacent surfaces, or pads 47, of the bearing 40 may, most suitably, be hard-coated with a material that increases the wear life of the bearing 40. Such hard coatings include, for example, chrome oxide and tungsten carbide. The bearings 40 may be of a single pad design or multiple pad 47 design as shown in FIGS. 3 and 4, which depicts a two-pad 47 design having two inner surfaces 46 that provide two bearing surfaces for the drive shaft 12.

As best seen in FIGS. 3 and 4, the cylindrical body 42 is formed with an internal cavity 50 in which a lubricant is pre-loaded during assembly of the pump 10. The lubricant may be any suitable material, such as grease. The grease acts to lubricate the area of contact between the inner surface 46 of the bearing 40 and the outer surface 48 of the drive shaft 12.

The cylindrical body 42 is further configured with an annular shoulder 52 that extends inwardly from a first end 54 of the bearing and an annular shoulder 56 that extends inwardly from the second end 58 of the cylindrical body 42. The annular shoulders 52, 56 are sized in depth (as measured from the end 54, 58 of the cylindrical body 42 inwardly toward the other end of the cylindrical body 42) to accommodate one or more (at least one) sealing elements 59. In some embodiments only one end of the bearing is arranged with a shoulder fitted with such a sealing element 59.

Figure 7:
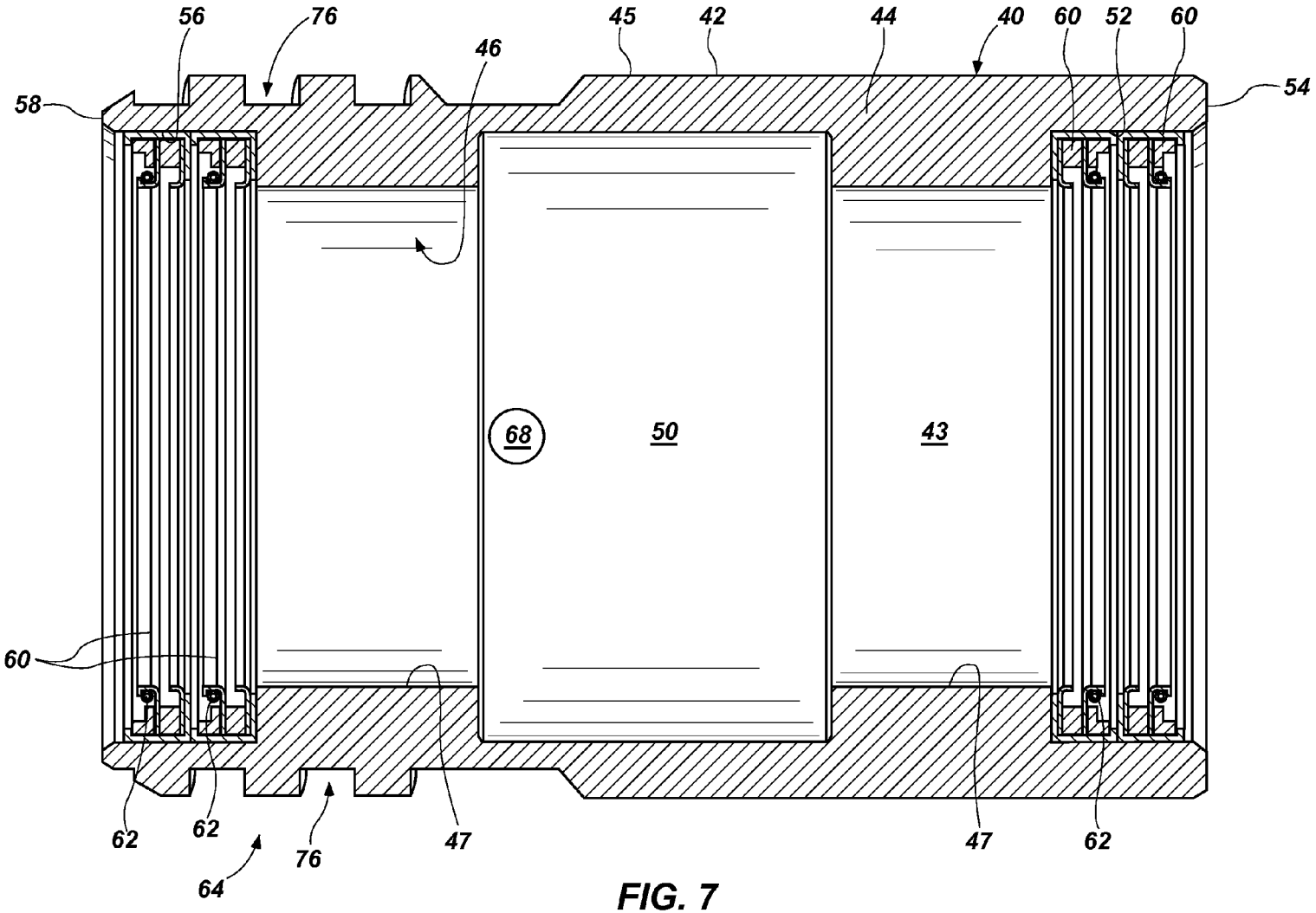
FIG. 7 is a view in cross section of the bearing illustrated in FIG. 6.
Figure 8:
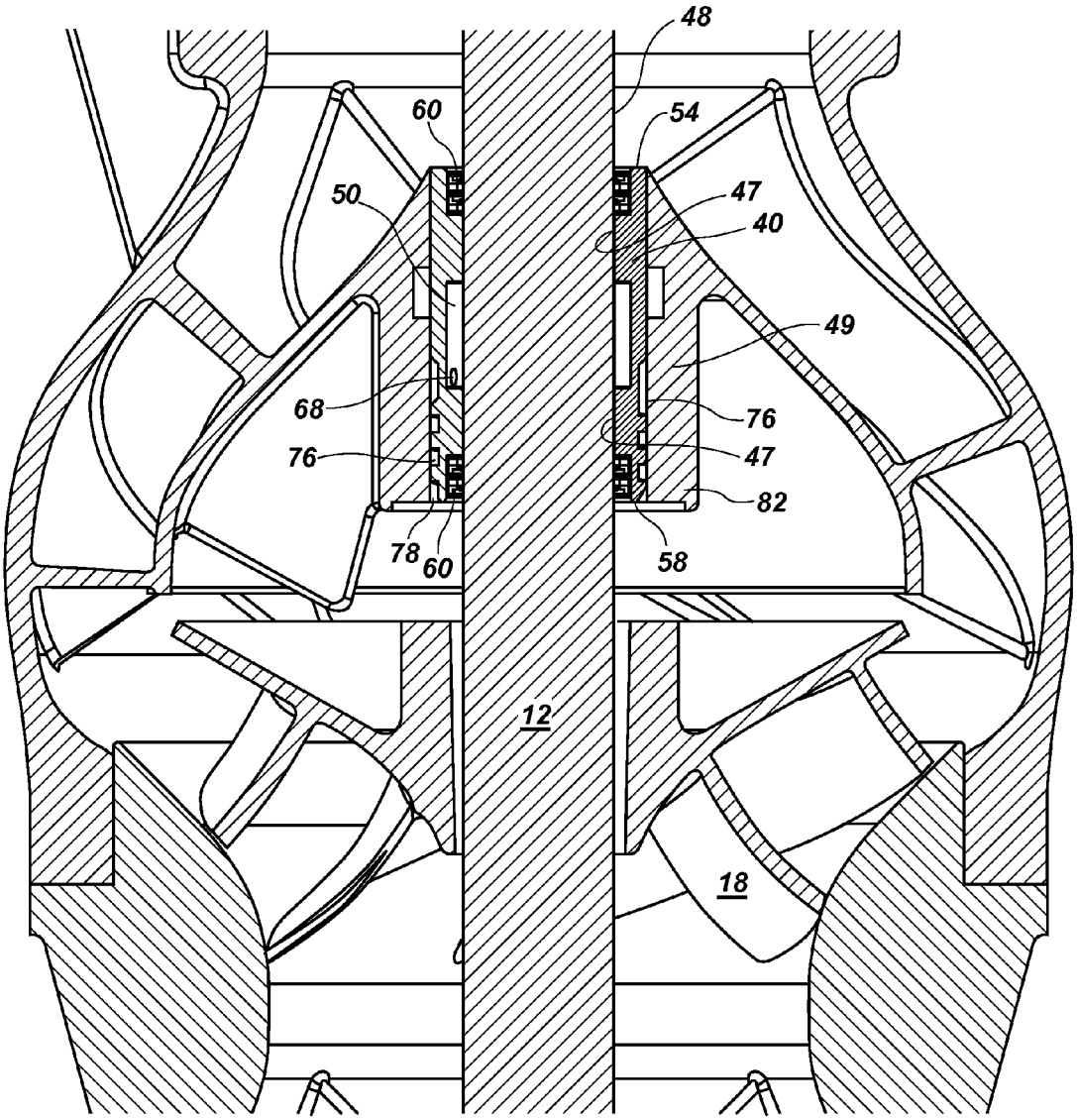
FIG. 8 is a view in cross section of a pump casing depicting the bearing shown in FIG. 5 positioned about the drive shaft of a vertical turbine pump.
Figure 9:
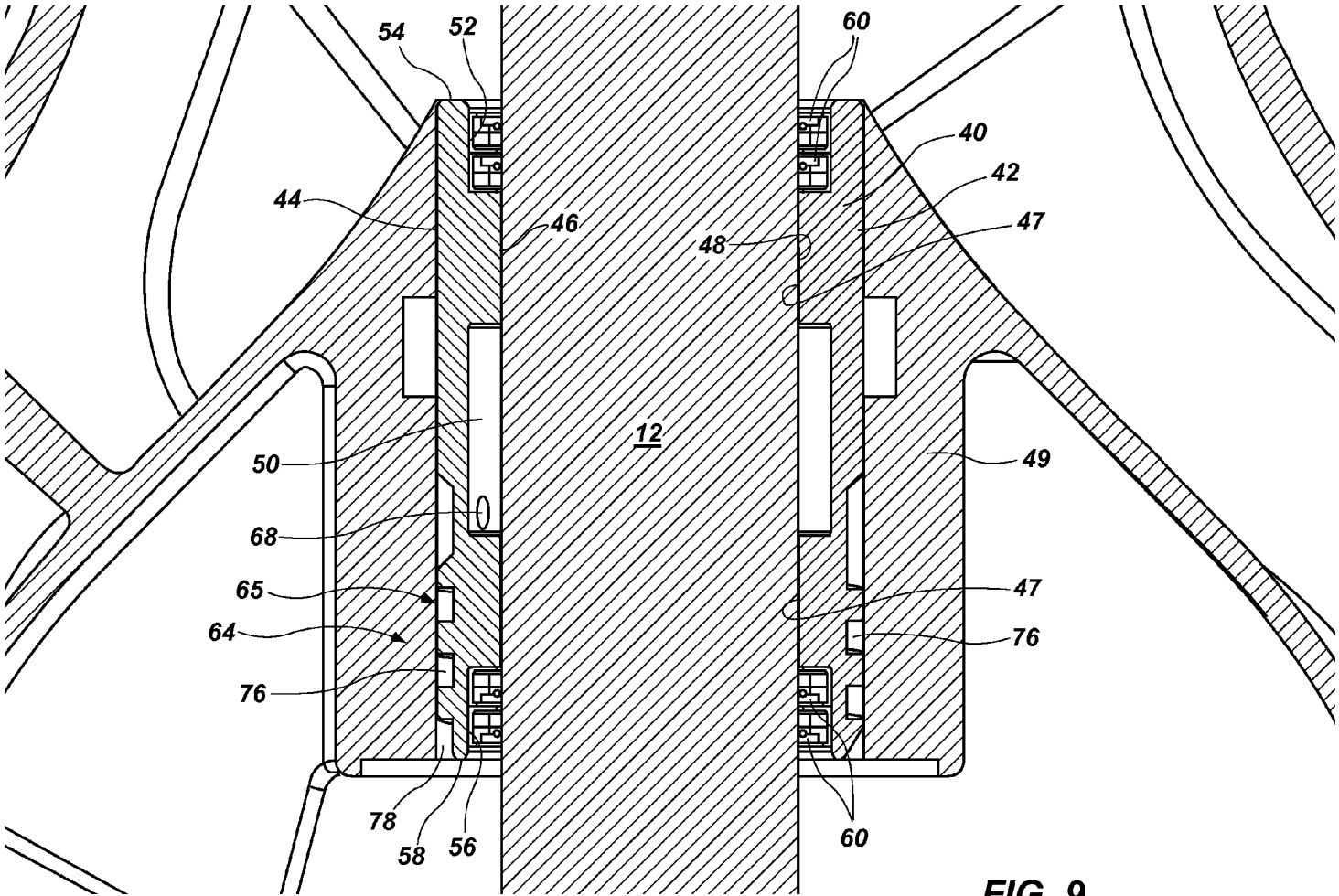
FIG. 9 is an enlarged view of the cross section illustrated in FIG. 8.

In one particularly suitable embodiment as shown in the drawings, the sealing elements 59 may be a series of annular lip seals 60 that surround and contact the outer surface 48 of the drive shaft 12. In a particularly suitable embodiment shown in FIGS. 2-4, each annular shoulder 52, 56 may be sized to receive and retain two double lip seals 60. The lip seals 60 may preferably be constructed from a strong and resilient material, such as PTFE, although other suitable materials may be used in construction of the lip seals 60. The lip seals 60, as depicted in FIG. 7, may also be reinforced with reinforcing rings 62. The use of serial lip seals 60 in each annular shoulder 52, 56 provides improved sealing of the bearing 40 against the infiltration of slurries or abrasives into the inner surface 46 of the bearing 40, especially if the outermost lip seal (i.e., the lip seal closest to the end 54, 56 of the cylindrical body) fails. Notably, other types of seal elements, such as mechanical seals or other means or sealing devices may be employed, and lip seals are described herein by way of example only.

While the serial lip seal arrangement improves the service life of the bearing, it was discovered that the lip seal service life and the life of the bearing itself could be increased even further by providing a means for equalizing the pressure differential that exists between the interior of the bearing, or the bearing cavity 50, and the environment outside of the bearing. That is, the inventor discovered that a pressure differential existing between the inner cavity 50 of the cylindrical body 42 and the area outside the cylindrical body causes the lip seals to fail because of the exertion of high pressure forces on the lip seals. The inventor discovered that providing a pressure equalization element would lessen the pressure on the lip seals, thereby increasing the service life and pressure handling capability of the lip seals.

Thus, in one aspect of the disclosure, a pressure equalization element 64 is provided in the cylindrical body 42 of the bearing 40. One example of a pressure equalization element 64 is shown in FIGS. 2-4. In the illustrated aspect of the disclosure, the pressure equalization element 64 comprises a channel 65 formed in the cylindrical body 42. The channel 65 illustrated in FIGS. 2-4 is a labyrinthine channel 66 that extends from an opening 68, which is formed through the thickness T of the continuous wall 44, to an exit point 70 at the second end 58 of the cylindrical body 42. The opening 68 in the continuous wall 44 provides fluid communication between the internal cavity 50 of the cylindrical body and the labyrinthine channel 66, while maintaining a degree of isolation of the internal cavity 50 from the pumped fluid during use of the bearing 40 in an operating pump.

In operation of the pump, a pressure differential is generated across the bearing 40 such that the internal cavity 50 is at a lower pressure relative to the pressure that exists outside of the bearing 40 at the ends 54, 58 of the bearing 40, resulting from the pumping of fluid. By providing a pressure equalization element 64 in the bearing 40, such as the labyrinthine channel 66, pumped fluid exerts pressure on the labyrinthine channel 66 at the exit point 70, forcing fluid to enter the channel 66. A resulting pressure is exerted on the grease in the labyrinthine channel 66 forcing the grease to remain in the internal cavity 50 to lubricate the adjacent surfaces 47 of the inner surface 46 of the cylindrical body 42, as opposed to the pumped fluid entering into this internal cavity. At the same time, the equalization of the pressure effected by the labyrinthine channel 66 reduces the differential pressure across the lip seals 60 thereby increasing the service life of the lip seals. Consequently, the pressure equalization element 64 facilitates an increased service life for both the sealing elements 59 and the bearing 40 itself.

Other embodiments which are operative to regulate the pressure differential between the internal cavity 50 and the pump chamber environment outside of the bearing 40, whilst maintaining the cavity 50 in isolation from the pumped fluid in the pump chamber environment, are suitable. The labyrinthine channel 66 illustrated in the figures is but one possible configuration for a pressure equalization element 64 that may be employed in the bearing 40, and many other possible configurations or devices may be employed. The labyrinthine channel 66, or another channel of a different shape or configuration, functions as a type of reservoir, into or out of which the movement of lubricant enables the pressure in the cavity 50 and the pump chamber to be equalized. Other forms of this are possible. For example, as shown in FIGS. 5-9, where like elements are illustrated with the same reference numerals, the pressure equalization element 64 may be in the form of a spiral channel 76. In this embodiment, the spiral channel 76 encircles the outer surface 45 of the cylindrical body 42 and extends between the opening 68 and an exit point 78 proximate the end 58 of the cylindrical body 42. It is also possible that more than one pressure equalization element 64 may be employed in the bearing 40, a single pressure equalization element 64 being illustrated in the figures. It is possible, for example, to provide a pressure equalization elements at either or both ends 54, 58 of the cylindrical body 42 of the bearing 40.

Figure 10:
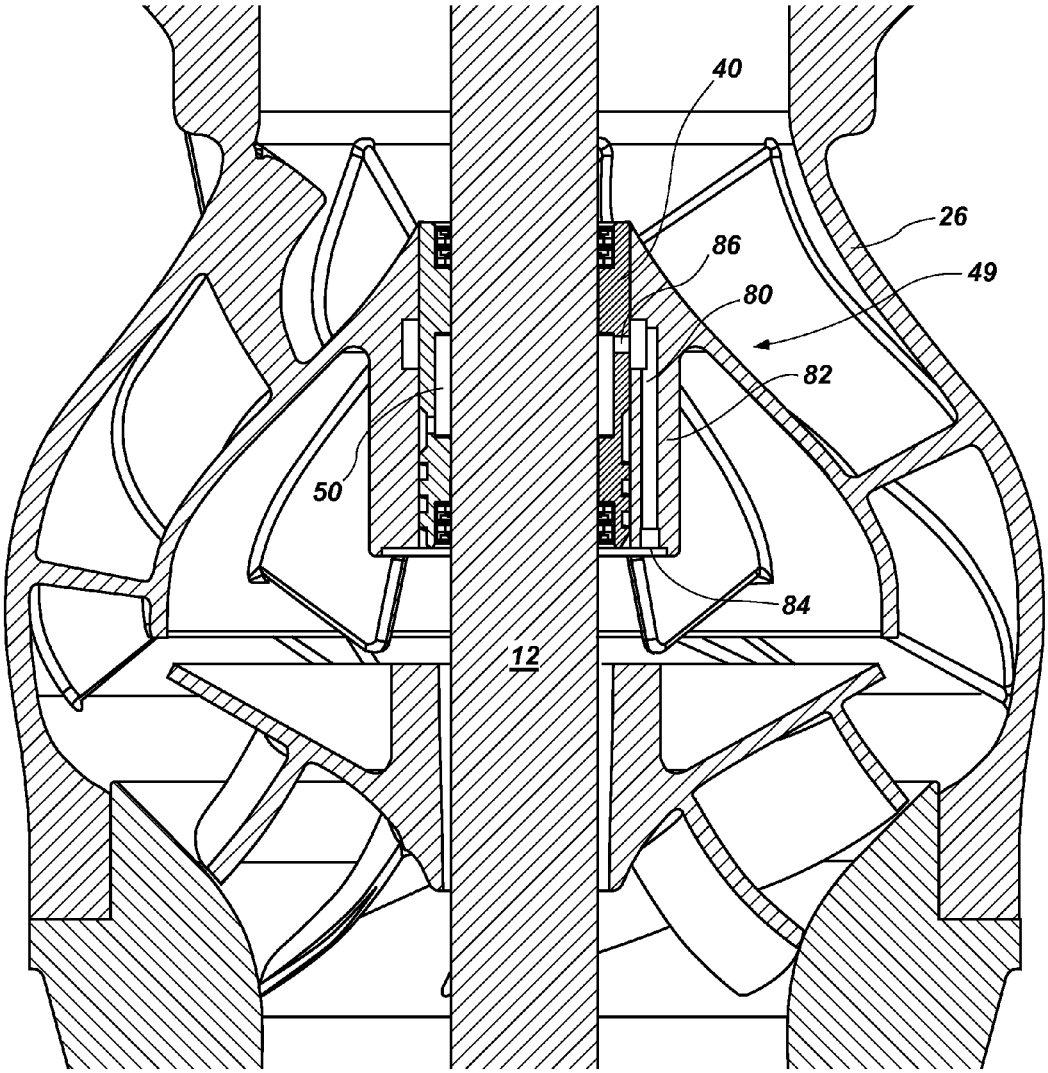
FIG. 10 is a view in cross section of a further embodiment of the pressure equalization element of the present disclosure.
Figure 11:
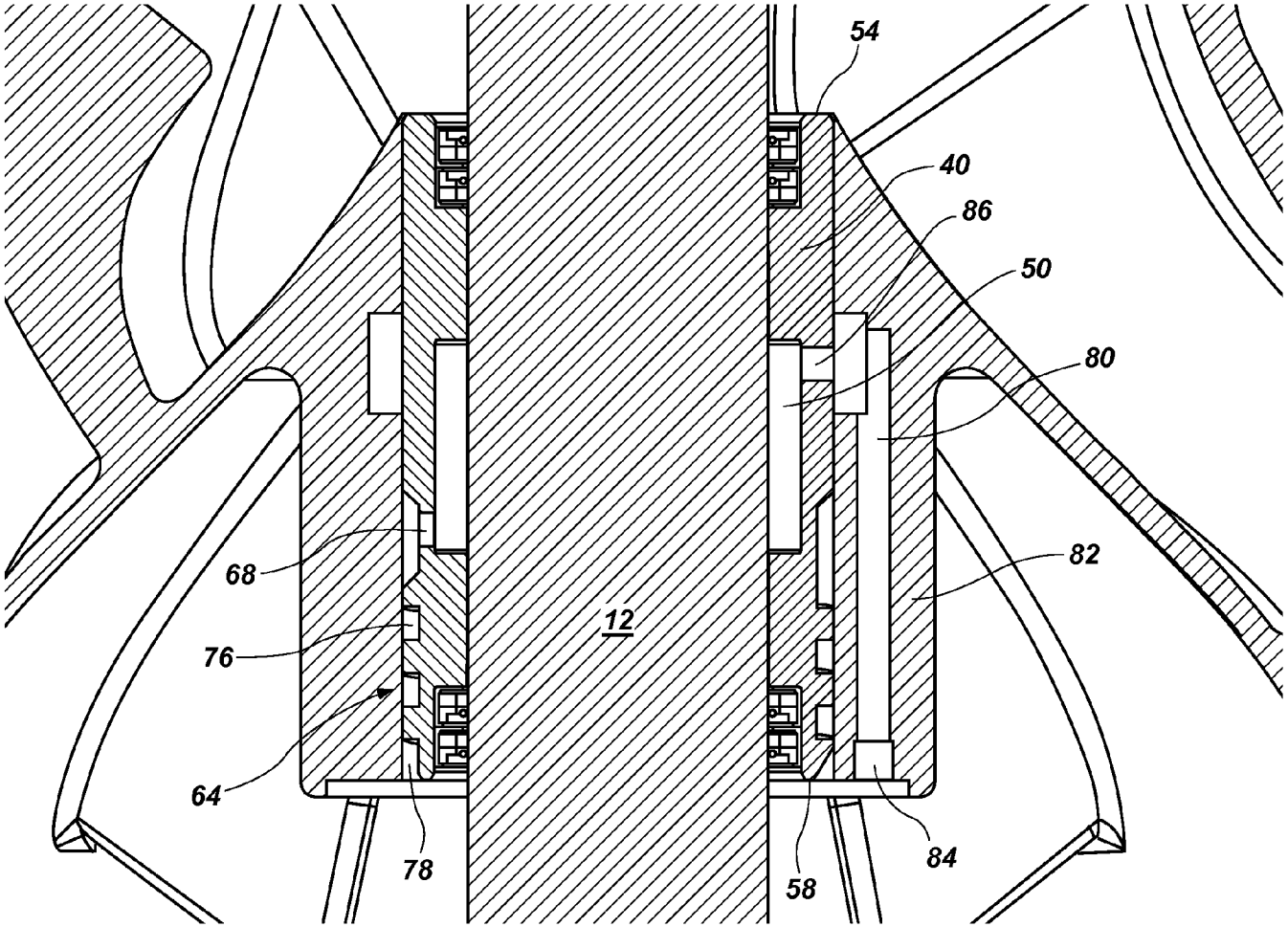
FIG. 11 is an enlarged view of the cross section illustrated in FIG. 10.

In a further aspect of the disclosure, illustrated in FIGS. 10 and 11, a lube port 80 may be provided in the supporting structure 49, shown as the hub 82 of the bowl casing 26. The lube port 80 may be a zerk fitting that is threadedly fitted into the hub 82. The lube port 80 is positioned such that an opening 86 in the continuous wall of the bearing 40 that communicates with the cavity 50 may be positioned in fluid communication with the lube port 80 to provide means for injecting lubricant through the hub 82 of the bowl casing 26, into the lube port 80 and into the cavity 50 during assembly of the pump 10. The lube port 80 may also be configured and positioned to be in fluid communication with the opening 68 in the bearing 40. The lube port 80 may also provide some measure of pressure equalization by virtue of pressurized fluid acting on the opening 84 of the lube port 80 through the hub 82, which forces lubricant in the lube port 80 toward the cavity 50 of the bearing 40.

Figure 5:
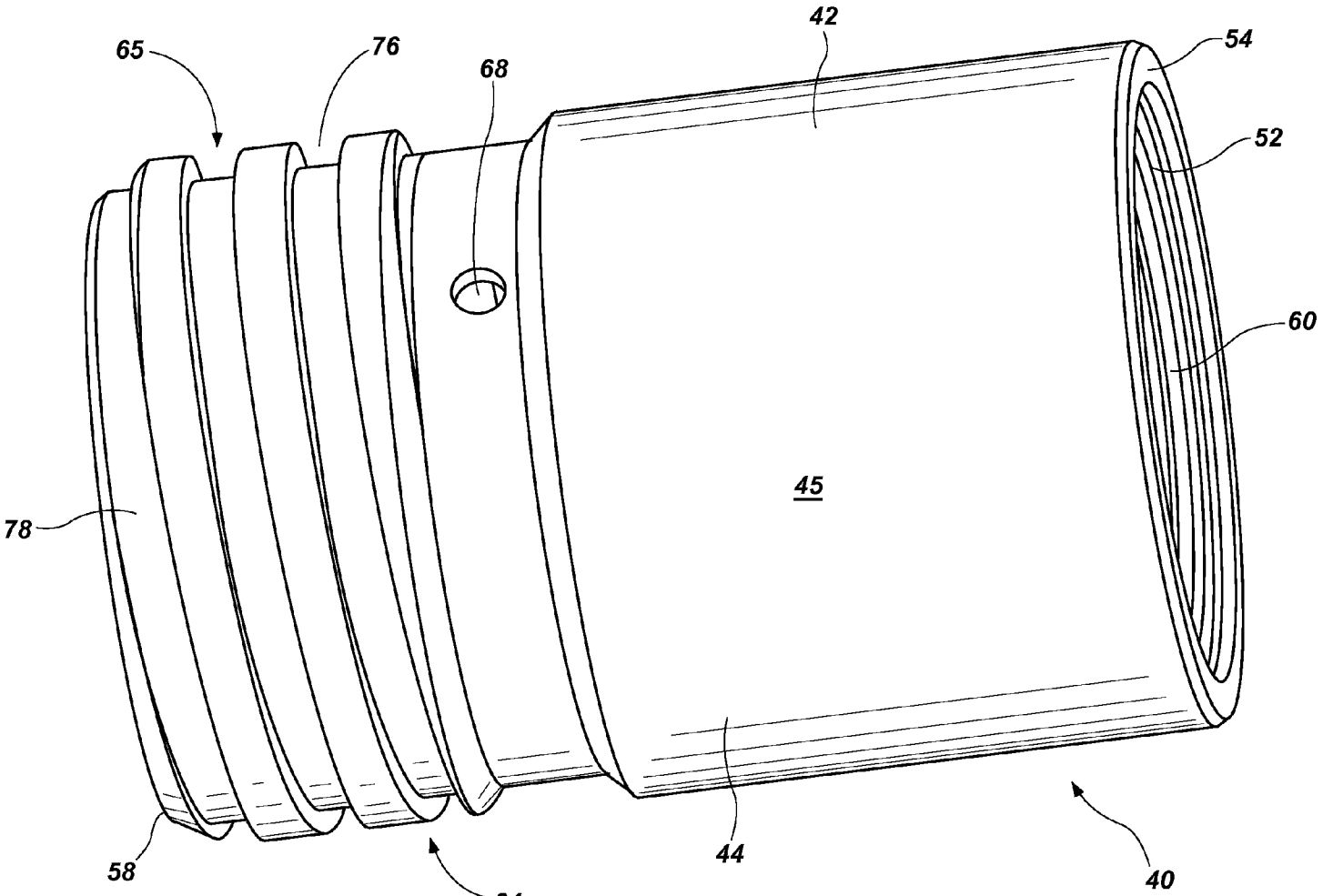
FIG. 5 is a perspective view of a bearing in accordance with another aspect of the disclosure.
Figure 6:
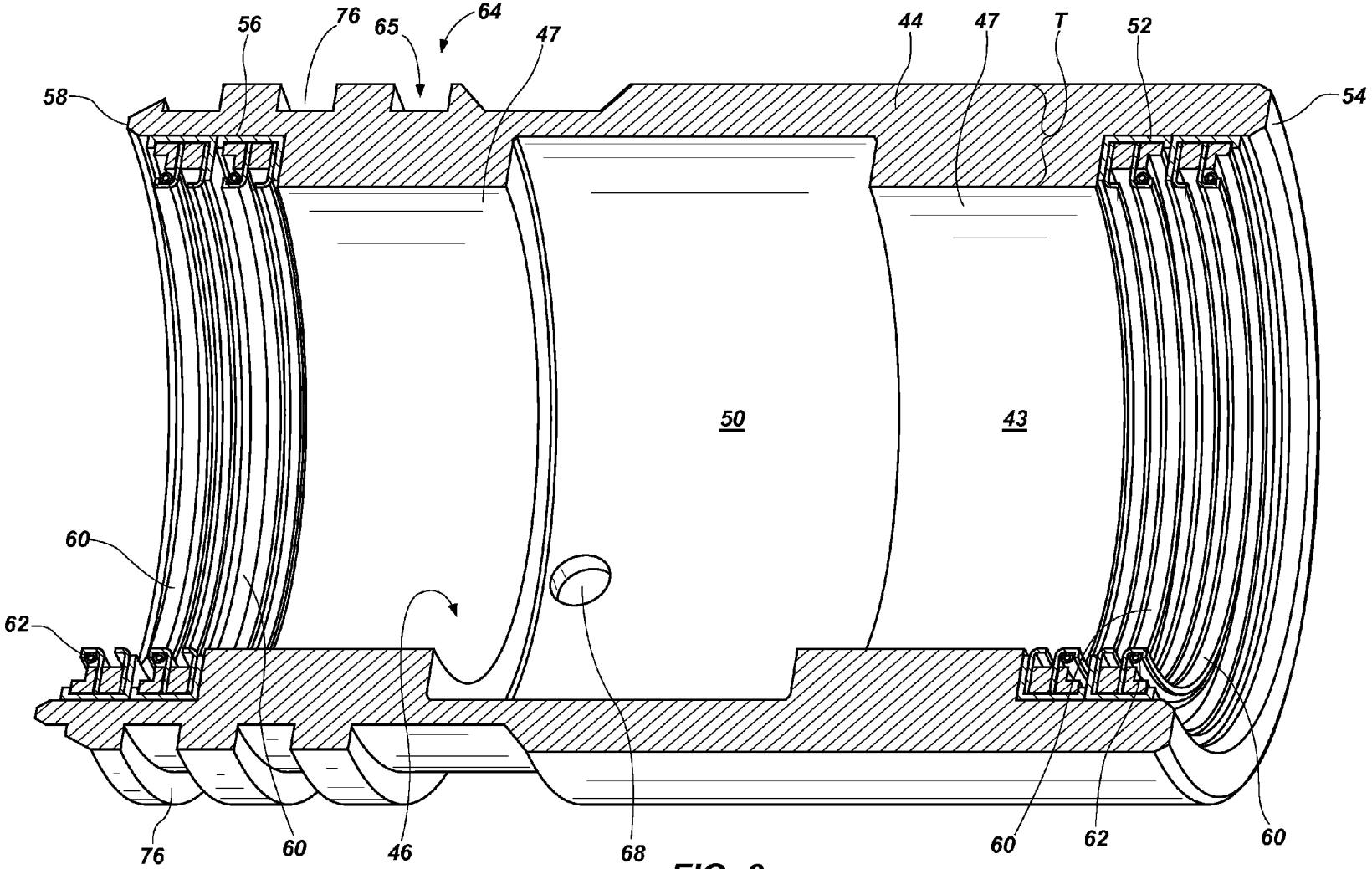
FIG. 6 is a perspective view of the bearing illustrated in FIG. 5, shown in cutaway.
Figure 12:
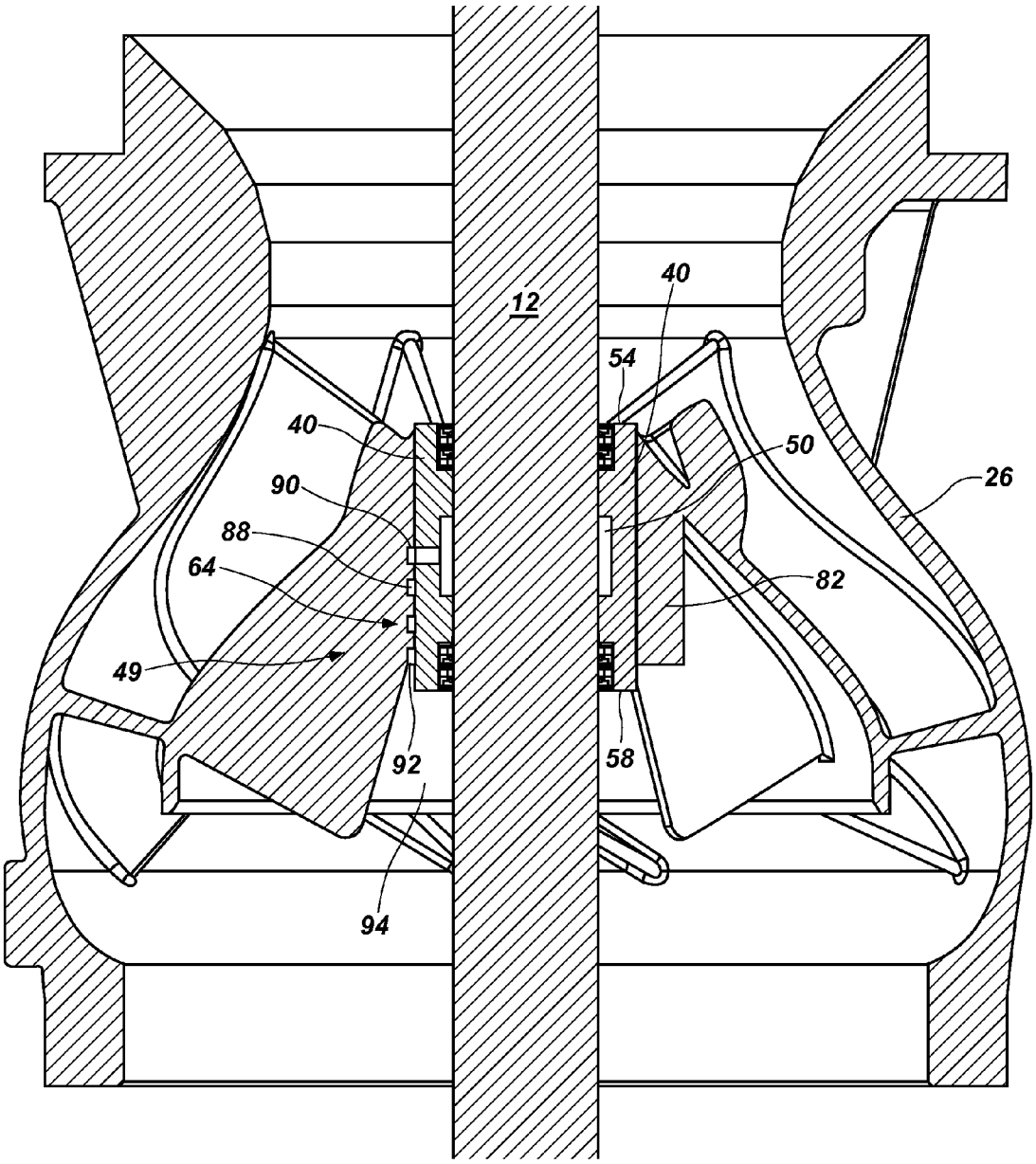
FIG. 12 is a view in cross section of a further aspect of the pressure equalization element in accordance with the present disclosure.

In a further aspect of the disclosure, the pressure equalization element 64 is located between the bearing 40 and a supporting structure 49 for the bearing 40, shown for example in FIG. 12 as being the hub 82 of the bowl casing 26. The pressure equalization element 64 in this embodiment may be in the form of a spiral channel or labyrinthine channel 88, similar in configuration to the channel 66 shown in FIG. 2 or FIG. 5, except that, rather than the channel being formed in the outer surface of the bearing 40, as depicted in FIGS. 2 and 5, the channel is formed in the supporting structure 49. The pressure equalization element 64 may be any other suitable device or configuration. The labyrinthine channel 88 may be pre-packed or otherwise filled with a lubricant. The labyrinthine channel 88 comprises a first end 90 which is positioned to communicate with the opening 68 in the bearing 40 to provide fluid communication with the cavity 50 of the bearing 40, and has a second end 92 which exits to the interior 94 of the bowl casing 26. Thus, pressure in the bowl casing 26 acts on the labyrinthine channel 88 to force the lubricant toward the cavity of the bearing 40 in the manner previously described. The pressure equalization element 64 shown in FIG. 12 provides equalization of pressure across the bearing 40 and extends the service life of the lip seals 60, as previously described.

The pressure equalization element 64, whether manifested in the cylindrical body 42 of the bearing 40 or in a supporting surface 49 for the bearing 40, such as a pump casing portion, may be made either by machining the bearing 40 or machining the casing portion using methods that are known and used in the industry. Alternatively, the bearing 40 or supporting surfaces 49 may be produced by casting methods, which are known in the art.

A vertical turbine pump in which a bearing assembly of the present disclosure is installed is most suitably assembled by first providing, a supporting structure, such as a pump casing portion, a bearing and a drive shaft. Notably, the pump casing may be any particular portion of the pump casing where a bearing of the type disclosed herein is needed, including the pump casing at a coupling joint between conjoined lengths of pump casing, or bowls that are provided for housing an impeller, or other suitable casing elements of a pump. The bearing is then positioned in engagement with the supporting structure or pump casing portion and the drive shaft is then positioned through the cylindrical body of the bearing. The bearing is situated with respect to the drive shaft so that the pressure equalization element is oriented toward an area of formation of increased pressure resulting from rotation of the drive shaft, during pump operation, to facilitate equalization of pressure between a point internal to the bearing proximate the drive shaft and the area of formation of increased pressure. Thus, for example, the pressure equalization element is oriented toward an area of the pump where a pressure differential has been generated by operation of the pump (i.e., rotation of the drive shaft), whereby the pressure differential is equalized as between the internal cavity 50 of the bearing 40 and an area external to the bearing 40.

Experimental data employing a bearing assembly as described in this disclosure has demonstrated consistent and satisfactory seal and bearing performance at various pressures (some exceeding the pressure rating of the seals that were used) resulting from the pressure equalization element. The data was produced from test runs using a four-stage vertical turbine pump having six bearing assemblies—one bearing assembly in each of the bowls and one bearing assembly in each bearing retainer in the column assembly. The pump was tested at pressures, external to the bearings, of from about 5 psi to upwards of 270 psi, and the lip seals that were used were rated from between 60 psi to 100 psi. Lip seal performance and wear patterns were consistent regardless of the amount of external pressure, thereby indicating that equalization of pressures was successfully obtained with the bearing assemblies. There was no observed failure of the lips seals, also indicating that pressure equalization had been achieved. Extended operation (e.g. twenty-four hours) revealed little if any appreciable wear on the shaft and journal bearings, which is a marked improvement over conventional structures and operations where pump operation for similar amounts of time showed some degree of wear on the shaft and journal bearings.

The bearing of the present disclosure provides improved service life of the bearing and its sub-elements, i.e., the lip seals. The bearing also provides improved operation of vertical turbine pumps by effectively eliminating the need for flushing mechanisms.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and "right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A bearing assembly for supporting a drive shaft within a vertical turbine pump, the bearing assembly comprising:

a cylindrical body having a continuous wall defining a passageway for receiving a drive shaft therethrough, and having an outer surface, an inner surface, a first end and a second end;

an internal cavity formed along said inner surface of said cylindrical body;

an annular shoulder extending inwardly from at least one of said first end and said second end, said annular shoulder being structured to receive and retain at least one sealing element;

at least one sealing element positioned in said annular shoulder; and a pressure equalization element formed in said cylindrical body in fluid communication with said internal cavity.

2. The bearing assembly of claim 1 further comprising an annular shoulder formed at each of said first end and said second end of said cylindrical body.

3. The bearing assembly of claim 1 further comprising an opening formed through said continuous wall and positioned to provide fluid communication between said cavity and said pressure equalization element.

4. The bearing assembly of claim 3 wherein said pressure equalization element comprises a labyrinthine channel formed along said outer surface of said cylindrical body and extending from said opening to one of said first end or said second end of said cylindrical body.

5. The bearing assembly of claim 3 wherein said pressure equalization element is a spiral channel formed along said outer surface of said cylindrical body to encircle said cylindrical body, and extending from said opening to one of said first end or said second end of said cylindrical body.

6. The bearing assembly of claim 1 wherein said at least one sealing element further comprises a series of lip seals.

7. The bearing assembly of claim 1 wherein said cavity is filled with a lubricant.

8. A vertical turbine pump, comprising:

a drive shaft being operatively connected to a drive means for rotating said drive shaft;

a casing element surrounding said drive shaft and providing a support structure;

a bearing positioned between said casing element and said drive shaft, said bearing comprising, a cylindrical body having a continuous wall defining a passageway for receiving the drive shaft therethrough, and having an outer surface, an inner surface, a first end and a second end;

an internal cavity formed along said inner surface of said cylindrical body;

an annular shoulder extending inwardly from at least one of said first end and said second end, said annular shoulder being structured to receive and retain at least one sealing element therein; and a pressure equalization element located between said casing element and said bearing and being in fluid communication with said internal cavity of said cylindrical body, the pressure equalization element containing, at least in part, a quantum of lubricant; and at least one impeller operatively connected to said drive shaft for rotation thereby.

9. The vertical turbine pump of claim 8 wherein the pressure equalization element comprises a labyrinthine channel.

10. The vertical turbine pump of claim 9 wherein the labyrinthine channel is formed in the outer surface of said cylindrical body.

11. The vertical turbine pump of claim 9 wherein the labyrinthine channel is formed in the casing element.

12. The vertical turbine pump of claim 8 wherein the pressure equalization element comprises a spiral channel.

13. The vertical turbine pump of claim 12 wherein the spiral channel is formed in the outer surface of said cylindrical body.

14. The vertical turbine pump of claim 12 wherein the spiral channel is formed in said casing element.

15. A pressure equalization element for a bearing assembly of a pump, the pressure equalization element comprising: a bearing positioned in use between a rotational drive shaft and a stationary pump casing portion, said bearing having an end, a wall, an internal cavity for retaining a lubricant therein, and having an opening extending through said wall from said internal cavity to a point at the exterior to said bearing wall; a channel element extending from said opening to a position toward the end of said bearing, wherein the pressure equalization element contains at least in part a quantum of lubricant.

16. The pressure equalization element of claim 15 wherein said channel element is formed in an outer surface of said bearing.

17. The pressure equalization element of claim 15 wherein said channel element is formed in said stationary pump casing portion.

18. Method for supporting a rotational drive shaft in a pump, comprising:

providing a drive shaft having an outer surface and a rotational axis; providing a bearing comprising a cylindrical body having a passage formed through the cylindrical body for receiving a drive shaft, an internal cavity and having at least one sealing element; providing a pressure equalization element between the internal cavity and a point exterior to the bearing which includes an element that extends from the internal cavity to a point exterior to said bearing; positioning the drive shaft through the passage of the bearing to position the bearing about the drive shaft and to position the pressure equalization element to extend from the interior cavity of the bearing to a point exterior to the bearing; and generating a pressure differential across the bearing to act upon the pressure equalization element to preserve the at least one sealing element of the bearing and to provide isolation of the interior cavity from an area of pressure external to the bearing.

19. The method according to claim 18 wherein the internal cavity is formed to be oriented toward and positioned adjacent the drive shaft, and wherein the pressure equalization element of the cylindrical body further includes a channel in fluid communication with the internal cavity and extending from the internal cavity to an outer surface of the cylindrical body, the channel containing an amount of lubricant, whereby, in generating the pressure differential, the pressure equalization element operates to equalize pressure between the internal cavity and the outside of the bearing.

20. Method for assembling a pump, comprising:

providing a drive shaft;

providing a supporting structure in proximity to the drive shaft;

providing a bearing comprising a cylindrical body having a continuous wall and having a passage for receiving a drive shaft therethrough, and further having a pressure equalization element positioned in contact with the cylindrical body and in fluid communication with a point internal to the cylindrical body proximate the drive shaft via an opening through said continuous wall;

positioning the bearing about the drive shaft and in engagement with the supporting structure; and orienting the pressure equalization element toward an area of formation of increased pressure resulting from rotation of the drive shaft to facilitate equalization of pressure between a point internal to the bearing proximate the drive shaft and the area of formation of increased pressure.

21. The method in accordance with claim 20 wherein the cylindrical body of the bearing includes an internal cavity formed to be oriented toward and positioned adjacent the drive shaft, and wherein the pressure equalization element of the cylindrical body further includes a channel in fluid communication with the internal cavity, which extends from the internal cavity to an outer surface of the cylindrical body, the channel containing an amount of lubricant, wherein orienting the pressure equalization element toward an area of increased pressure further comprises exposing the lubricant within the channel to the area of increased pressure.

22. The method in accordance with claim 20 wherein the cylindrical body of the bearing includes at least one sealing element positioned at one end of the cylindrical body, the method further comprising orienting the cylindrical body of the bearing to dispose the at least one sealing element toward the area of increased pressure.

23. The method in accordance with claim 20 wherein the internal cavity and channel of the pressure equalization element are filled with lubricant after positioning the bearing about the drive shaft.

* * * * *